United States Patent [19]

Nowak

[11] Patent Number: 4,553,269

[45] Date of Patent: Nov. 19, 1985

[54] POCKET STRUCTURE

[76] Inventor: Daniel Nowak, 720 Canal St., New Orleans, La. 70130

[21] Appl. No.: 635,083

[22] Filed: Jul. 27, 1984

[51] Int. Cl.[4] ..... A41D 27/20

[52] U.S. Cl. ..... 2/254

[58] Field of Search ..... 2/247, 248, 250, 251, 2/252, 253, 254

[56] References Cited

U.S. PATENT DOCUMENTS

| | | | |
|---|---|---|---|
| 851,966 | 4/1907 | Shaw . | |
| 1,756,467 | 4/1930 | Mayer . | |
| 1,821,809 | 9/1931 | Johnson . | |
| 1,821,837 | 9/1931 | Johnson | 2/254 |
| 2,486,584 | 9/1949 | Yagodnik . | |
| 2,859,449 | 8/1955 | Ellison . | |
| 2,899,684 | 7/1957 | Riley . | |
| 3,772,708 | 11/1973 | Segelin . | |
| 3,981,028 | 9/1976 | Siegel | 2/254 |

*Primary Examiner*—Doris L. Troutman

*Attorney, Agent, or Firm*—Sughrue, Mion, Zinn, Macpeak & Seas

[57] ABSTRACT

A pocket structure is provided with a chamber to conceal a valuable object such as a billfold. The pocket has a front panel, a back panel and two intermediate panels. The front panel has a slit to form a pocket opening and a flap is provided to close the opening. Behind the first panel is a first intermediate panel which is secured inside the pocket to the lower seam and side seams by a row of stitching. The upper edge of the first intermediate panel extends above the slit behind the flap. The second intermediate panel is secured at its top edge to a support strip. The side edges and the bottom edge of the second intermediate panel are distal from the side edges and bottom edges of the front panel, rear panel and first intermediate panel. The space behind the rear panel and the second intermediate panel define a hidden chamber to conceal a valuable object such as a billfold.

4 Claims, 3 Drawing Figures

POCKET STRUCTURE

BACKGROUND OF THE INVENTION

1. Field of the Invention

This invention pertains to pants pocket structures of the type to provide a hidden chamber to conceal a valuable object such as a billfold or the like from being removed by a thief.

2. Background of the Prior Art

The prior art discloses pants pocket structures having an inner flap behind which a billfold is positioned to prevent unwanted removal of same. Unlike Applicant's simplified yet fail-safe pocket structure, the prior art is complicated and costly to construct.

SUMMARY OF THE INVENTION

This invention is a simplified pocket structure which is easy to install on a pair of pants during the manufacture of same.

It is one object of this invention to provide a pocket structure having a hidden chamber to conceal a valuable object such as a billfold.

It is another object of this invention to provide a pocket structure having a first panel with a slit opening and an inside flap with a button to close said opening.

It is yet another object of this invention to provide a first intermediate panel inside the pocket, the bottom and side edges of which are sewn to the bottom and side edges of the front and rear panels. The upper edge of the first intermediate panel extends above said opening and is behind the flap.

And still another object of this invention is to provide a second intermediate panel having an upper edge sewn to a support strip behind the flap and above the slit opening. The side edges and bottom edge of the second intermediate panel are distal from the side edges and bottom edges of the front panel, rear panel and first intermediate panel.

A further object of this invention is to provide a pocket structure having a first chamber to hold non-valuable articles, a second empty chamber and a third hidden chamber to conceal a valuable object such as a billfold.

It is still a further object of this invention to provide a pocket structure which will require the user to extend his/her fingers into the pocket opening, upwardly over the top edge of the first intermediate panel, downwardly into the empty chamber to grasp the bottom edge of the second intermediate panel, raise same and insert a billfold into the hidden chamber defined by the second intermediate panel and the rear panel.

DESCRIPTION OF THE PREFERRED EMBODIMENT OF THE INVENTION

Figure 1:
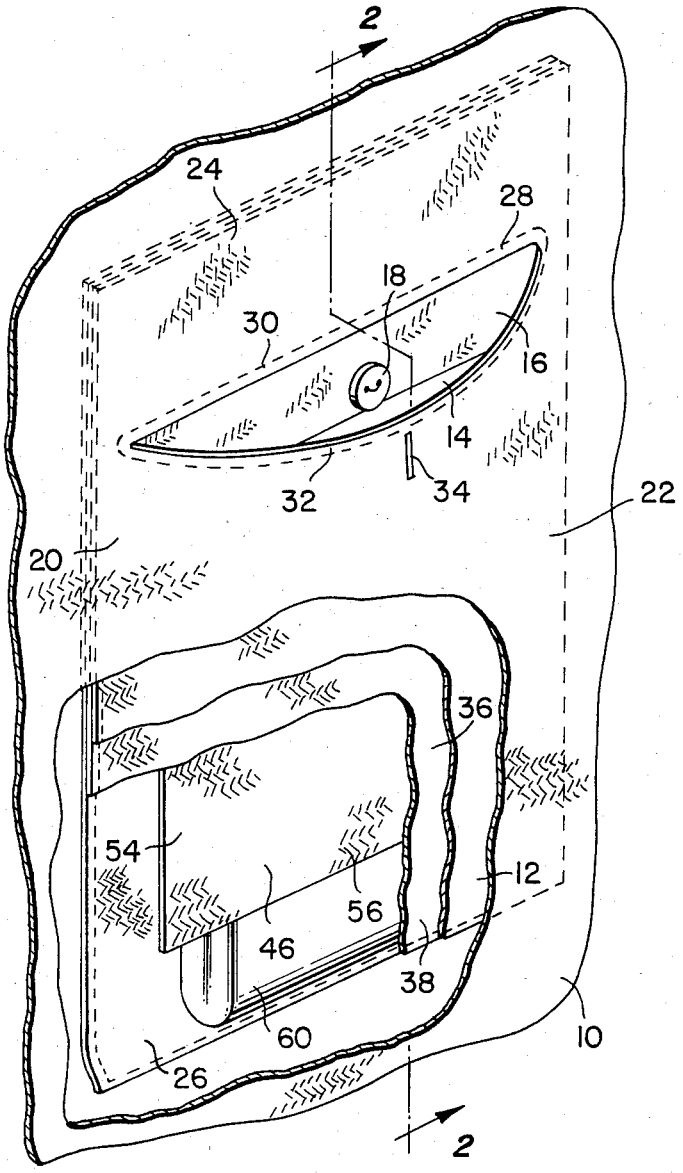
FIG. 1 is a perspective view, partly in section, of a pocket structure with a button hole, pocket opening and closure flap with button. The figure shows a front panel, first intermediate panel, second intermediate panel and rear panel.
Figure 2:
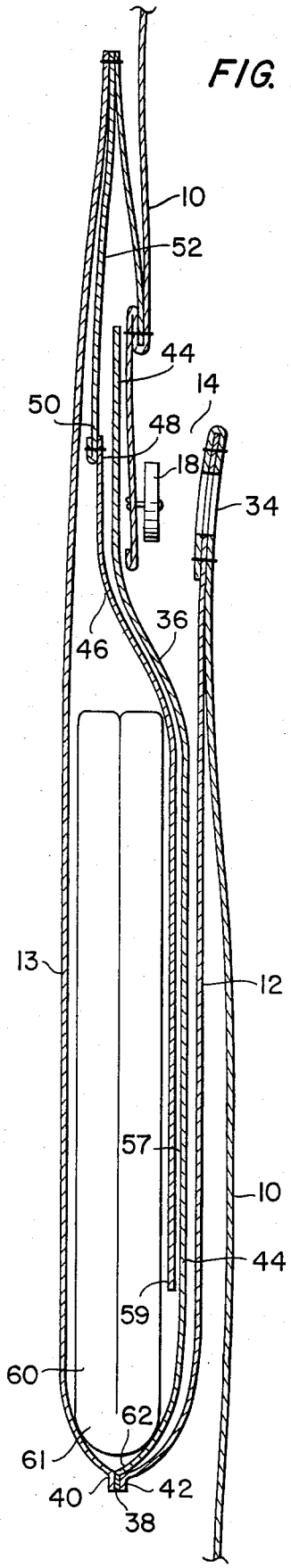
FIG. 2 is a side view in section showing a portion of the rear of a pair of pants, a front panel of a pocket structure, a first intermediate panel, a second intermediate panel, a rear panel and a billfold between the second intermediate panel and the rear panel.

Referring in more detail to the drawings, FIGS. 1 and 2 show a portion of the rear part 10 of a pair of pants. The pocket structure has a front panel 12 and a rear panel 13 sewn together at their edges by a row of stitching. The front panel 12 has a slit opening 14 and a closure flap 16 with a button 18. The front panel has side edges 20 and 22, and top and bottom edges 24 and 26. The flap 16 is a part of the pants 10 and is sewn to the front panel 12 by a row of stitching 28 about the edges 30 and 32 of the front panel 12 near the slit opening 14. As can be seen from the drawings, the flap 16 is behind the front panel 12 and is closable against the inside of the front panel by a button 18 and a button hole 34.

Behind the front panel 12 is a first intermediate panel 36 which is the same width as the front and rear panels and is sewn at its bottom edge 38 and side edges (not shown) to the bottom edges 40 and 42 and side edges (not shown) of the front and rear panels 12 and 13. The upper edge 44 of the first intermediate panel 36 extends above the slit opening 14 and is behind the flap 16. The front panel 12 and the first intermediate panel 36 define a first chamber 44 of the pocket which may be used to hold non-valuable items such as printed matter or handkerchieves or the like.

The second intermediate panel 46 is smaller in width and length than the first panel, first intermediate panel and rear panel which three are of equal dimension. The top edge 48 of the second intermediate panel is sewn to a bottom edge 50 of a strip of support fabric 52 which is sewn at its edges (not shown) to the edges of the other panels. The side edges 54 (one shown) intermediate panel are distal from the side edges of the other panels and the bottom edge 56 of the second intermediate panel is distal from the bottom edges of the other panels. The space between the two intermediate panels define a second chamber 57 which may be used to hold non-valuable articles or it may be left vacant. The rear panel and the second intermediate panel define a third hidden chamber 59 for securing a billfold 60 having a rounded side 61 snugly resting against the rounded inside cradle 62 defined by the bottom edges of the first intermediate panel and the rear panel. The second intermediate panel is thicker and is made of heavier material such as burlap than the other panels because of the frequency of handling in placing and removing a billfold.

Figure 3:
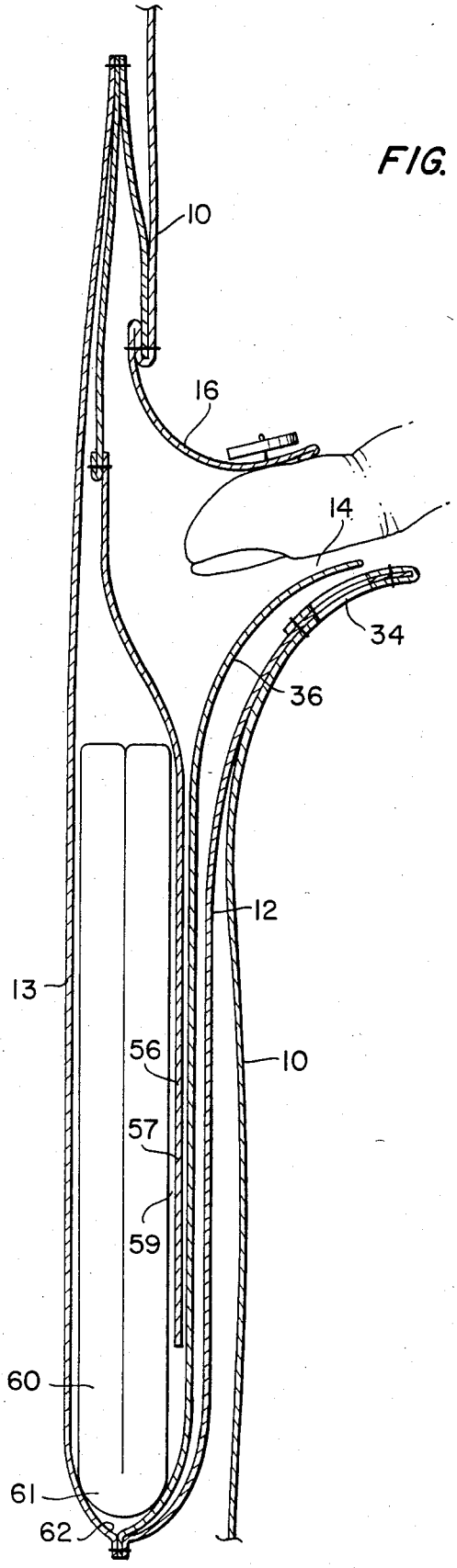
FIG. 3 is similar to FIG. 2 and shows the procedure for positioning or removing a billfold in a hidden chamber defined by the second intermediate panel and the rear panel.

For the procedure in inserting or removing the billfold 60, refer to FIG. 3 wherein the arrow shows a user extending his/her fingers into the pocket opening and reaching behind the flap to grasp the top edge of the first intermediate panel. The user then draws the panel forwardly and extends the fingers and hand into the second chamber and grasps the bottom edge of the second intermediate panel, raising same to permit placing the billfold 60 between the rear panel and the second intermediate panel. The space between these panels define a concealed chamber to secure the billfold against unauthorized removal by a thief. The pocket opening is closed by the flap 16, button 18 and button hole 34. The first chamber 44 may be used for carrying non-valuable articles such as printed matter or handkerchieves or the like. The second chamber 57 may also be used to store non-valuables but is probably left vacant.

A would be thief would be unlikely to get across into the second chamber since it would be unlikely for such a party to reach inwardly and upwardly behind the flap to attain access to the second chamber. It would be very unlikely that a would be thief would reach the hidden chamber behind the first two chambers wherein a valuable article may be stored. Moreover, even if a would be thief had knowledge of a hidden chamber for a valuable article, it would be extremely difficult for such a party to go through the maneuvers of attaining access to said hidden chamber without the knowledge of the party wearing the pants.

While the invention has been shown and described in detail with reference to preferred embodiment thereof, it will be understood to those skilled in the art to which this invention pertains that various changes in form and detail may be made therein without departing from the spirit and scope of the invention.

What I claim is:

1. A pocket structure comprising:

a front panel having a bottom edge and a pocket opening;

a flap to close said pocket opening;

a rear panel;

a first intermediate panel having a bottom edge and a top edge which is above the pocket opening and behind the flap;

a support strip behind the flap and above the pocket opening; and a second intermediate panel having a top edge secured to said support strip and having side edges distal from the side edges of the other panels and a bottom edge distal from the bottom edges of the other panels.

2. A pocket structure as defined in claim 1, wherein: said front panel and said first intermediate panel defining a first chamber for storing non-valuable articles.

3. A pocket structure as defined in claim 1, wherein: said first and second intermediate panels define a second chamber for storing non-valuable objects.

4. A pocket structure as defined in claim 1, wherein: said second intermediate panel and said rear panel define a hidden camera for storing a valuable object such as a billfold.

* * * * *